US005495929A

United States Patent [19]

Batalianets et al.

[11] Patent Number: 5,495,929

[45] Date of Patent: Mar. 5, 1996

[54] APPARATUS AND METHOD FOR VALIDATION OF BANK NOTES AND OTHER VALUABLE DOCUMENTS

[76] Inventors: Valeri V. Batalianets, #112-14/1 Rusanovskaja St.; Georgi O. Antonov, #42-39aKrasnozvezdnaja St., both of Kiev, Ukraine

[21] Appl. No.: 213,792

[22] Filed: Mar. 16, 1994

[51] Int. Cl.[6] ..... G07D 7/00

[52] U.S. Cl. ..... 194/207; 382/137

[58] Field of Search ..... 194/206, 207; 209/534; 382/7

[56] References Cited

U.S. PATENT DOCUMENTS

| | | | |
|---|---|---|---|
| 3,223,988 | 12/1965 | Danko | 209/534 X |
| 3,870,629 | 3/1975 | Carter et al. | 209/534 |
| 4,283,708 | 8/1981 | Lee | 194/206 |
| 4,584,529 | 4/1986 | Aoyama | 209/534 X |

*Primary Examiner*—F. J. Bartuska
*Attorney, Agent, or Firm*—Griffin, Butler, Whisenhunt & Kurtossy

[57] ABSTRACT

An apparatus for validating bank notes and other valuable documents having magnetic characteristics which provide a predefined signature. The validator comprises a receptor for receiving a bank note. The bank note is inserted in the receptor and pulled through a passage-way which includes magnetic and optical sensing chambers. The magnetic sensing chamber includes a sensor and a magnetic head for generating a magnetic field. When the bank note passes through the magnetic sensing chamber, the magnetic characteristics of the bank note affect the magnetic field and the sensor produces an output signal corresponding to the magnetic field. The validator includes a processor which processes the output signal to produce a bank note frequency value correlated to the signature of the bank note. The processor validates the bank note by comparing the frequency value to a base-line frequency value and determining the deviation from the base-line value. The base-line frequency value is determined before the bank note enters the magnetic sensing chamber and can be continuously updated to alleviate the effects of temperature and humidity on the magnetic field.

15 Claims, 7 Drawing Sheets

APPARATUS AND METHOD FOR VALIDATION OF BANK NOTES AND OTHER VALUABLE DOCUMENTS

FIELD OF THE INVENTION

The present invention relates to the field of bank note or like document validators, and more particularly to an apparatus for bank note validation which utilizes magnetic detection.

BACKGROUND TO THE INVENTION

Paper currency and other types of bank notes typically include some form of deterrent against counterfeiting. Currency printers typically attempt to deter counterfeiting by giving the currency predefined magnetic signatures. The magnetic signature can be realized by using ink or dyes which have magnetic properties, for example, the ink can contain magnetized particles which produce a magnetic flux. The magnetic properties of the ink can be controlled so that there is a defined magnetic signature associated with authentic currency.

In the prior art, there are known devices which are used to validate paper currency and other notes by sensing the magnetic characteristic or signature. These devices utilize a magnetic head or sensor which contacts the bill and detects the magnetic field produced by the ink. Because the magnetic field can be weak, prior art validators typically include a pressure roller which squeezes the bill against the magnetic head. Through continual use the magnetic head can pick up dirt and other debris from the paper currency. Over time, this debris contaminates the magnetic head and degrades the performance of the validator unless the head is cleaned periodically. In addition, the requirement of bill contact to perform the validation process can reduce the ability of validator to handle worn out or damaged notes. Furthermore, because the prior art devices rely on the detection of a magnetic field in the bank note, an authentic, but demagnetized, bank note will not be validated by the prior art device.

Another problem encountered with prior art bank note validators is their suspectibility to non-intrusive tampering. There are known bank note validators which can be tricked into producing credit pulses when exposed to an electrostatic discharge, such as those produced by so-called "stun guns".

BRIEF SUMMARY OF THE INVENTION

In a first aspect, the present invention provides a validator for validating the authenticity of bank notes and other valuable documents having a predefined signature which affects a magnetic field, said validator comprising: (a) receiving means for receiving the document, including a passage-way for receiving the document; (b) transport means for transporting the document through said passage-way; (c) signature detector means for detecting the signature of the document including magnetic means for producing a magnetic field in said passage-way, and sensing means for sensing change in said magnetic field created by the document and producing a sensor output signal in response thereto; and (d) processor means for processing said sensor output signal and generating an output signal indicative of an authentic document.

In a second aspect, the present invention provides a credit pulse issue circuit for use with a bank note validator which produces a modulated output signal containing an encoded denomination value for a bank note, said credit pulse issue circuit comprising: (a) input port means for inputting the modulated signal from the bank note validator; (b) demodulator means for demodulating the modulated output signal and producing a demodulated signal; (c) decoding means for decoding the denomination value from said demodulated signal; and (d) credit pulse generator means responsive to said demodulated signal for generating a series credit pulses corresponding to the denomination value.

The bank note validator according to the present invention achieves the following advantages. Firstly, the non-contactive nature of the magnetic sensing performed according to the invention allows the bank note validator to be used with worn paper currency because the note passes freely above the magnetic sensor without the need to press the note against the sensor. Secondly, because the bank note validator does not sense the strength of the magnetic field produced by particles in the ink, but rather changes to a reference magnetic field caused by the particles, the bank note validator can be used with currency in which the magnetic field produced by the ink has been weakened. Furthermore, changes to the reference magnetic field can be detected using a single magnetic sensor and irrespective of which bank note surface contains the ink with particles. Thirdly, the magnetic sensing utilized in the present invention can sense the magnetic properties in the ink irrespective of whether the bank note is moving or stationary with respect to the sensor. Fourthly, because the bank note validator senses changes to a reference magnetic field, the validator is not limited to documents having magnetic ink, but can be used with documents printed with ink doped with ferromagnetic or paramagnetic particles.

BRIEF DESCRIPTION OF THE DRAWINGS

For a better understanding of the present invention, and to show more clearly how it may be carried into effect, reference will now be made, by way of example, to the accompanying drawings which show preferred embodiments of the present invention, and in which.

DETAILED DESCRIPTION OF THE PREFERRED EMBODIMENT

Figure 1:
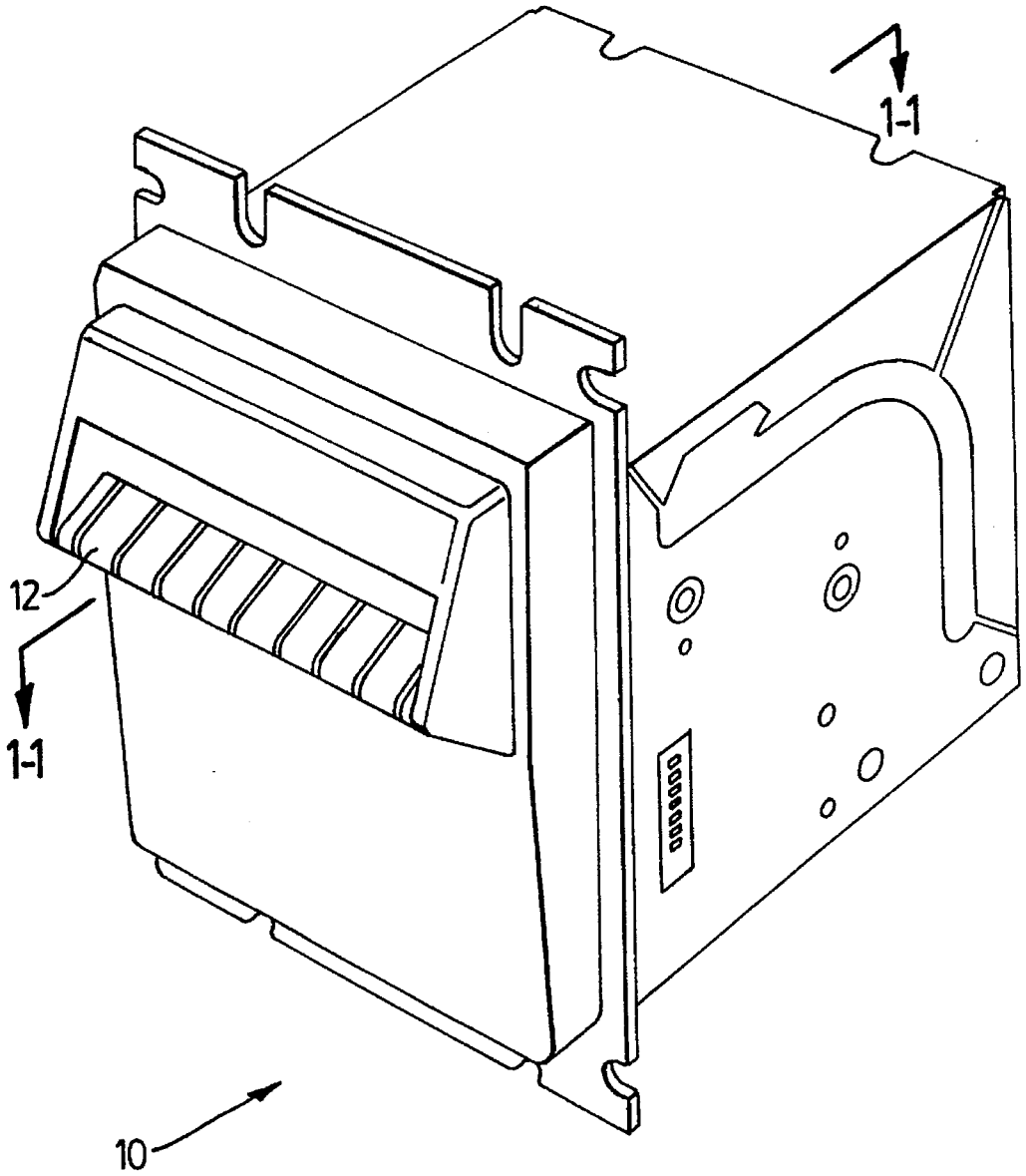
FIG. 1 is a perspective view of a preferred embodiment of a bank note validator according to the present invention.

Reference is first made to FIG. 1 which shows a perspective view of a preferred embodiment of a bill or bank note validator made in accordance with the present invention and denoted generally by reference 10. In the following description, the term bill and bank note are used interchangeably and refer to paper currency or other types of negotiable instruments. The validator 10 according to the invention can also be used to validate other documents which are printed on paper or some other flexible or semi-rigid substrate/film and exhibit predefined characteristics to which the bill validator is responsive as will be described.

The bill validator 10 comprises a device which accepts bills or bank notes and validates their authenticity and denomination. In response to an authentic bank note, the bill validator 10 issues credit pulses based on the detected denomination of the bill or note. These credit pulses are accepted and processed by additional devices, for example, a token dispenser for a public transportation system or a gambling chip dispenser in a casino. The bill validator 10 according to the invention is preferably constructed as a module (FIG. 1) which is integrated with other equipment for example, a subway token dispenser or a vending machine.

Figure 2:
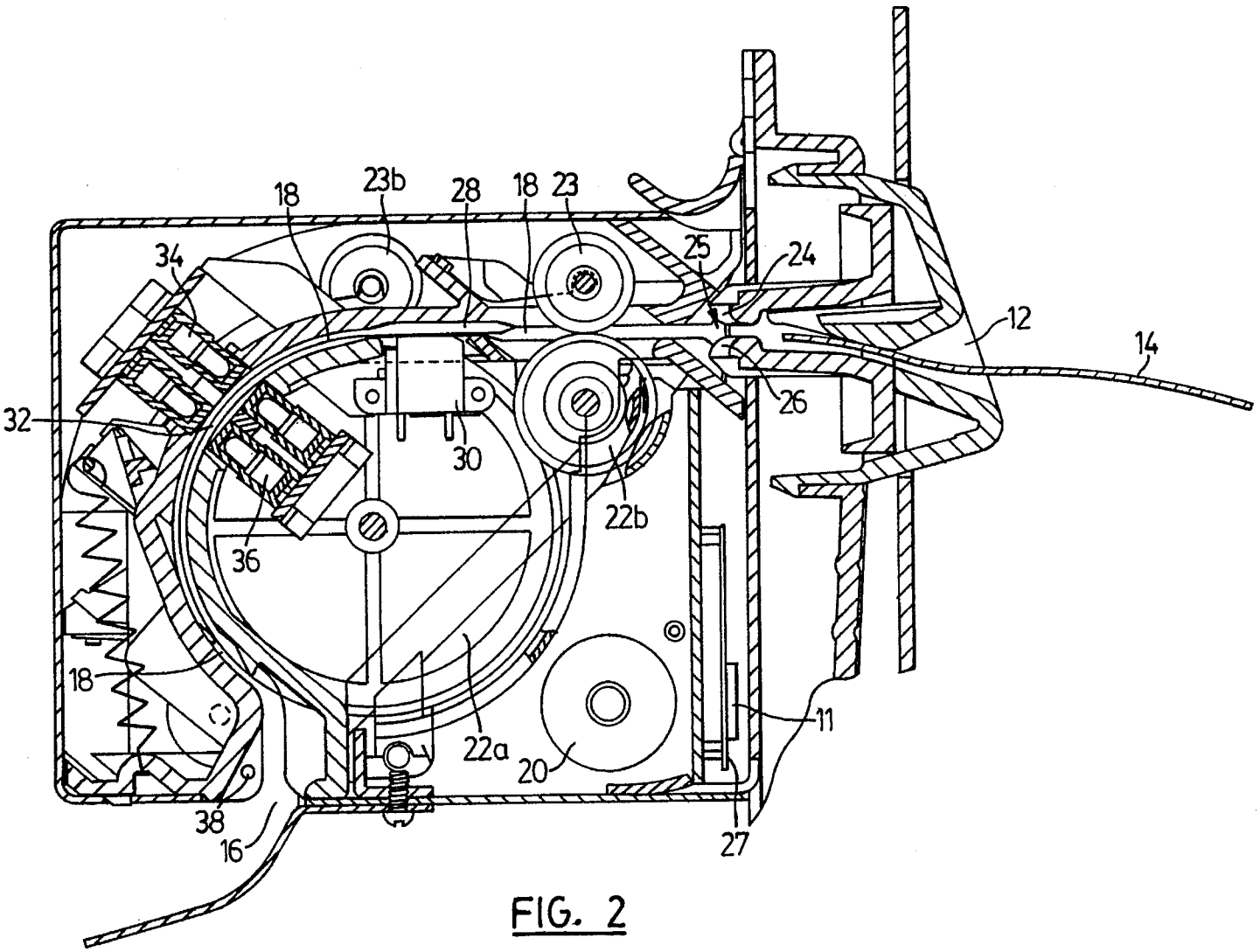
FIG. 2 is a sectional view of the bank note validator shown in FIG. 1 taken along line 1—1.

As shown in FIG. 1 and FIG. 2, the validator 10 includes a bill receptor 12. The bill receptor 12 is used to receive a bank note (denoted by reference 14 in FIG. 2), for example, a $10 bill is inserted into the validator 10. As will be described in detail below, the validator 10 detects the bill 14 once it is inserted and pulls it inside for validation and denomination. Once the validator 10 has validated the note 14 and determined the denomination, the note 14 is ejected through an output port 16. Typically, the output port 16 would be coupled to a secured deposit container or safe box which acts as a repository for collecting validated bills that were processed by the validator 10. The operation of the bill validator 10 is computer controlled by a microcontroller or microprocessor 11 which executes a computer program (i.e. firmware burned into read only memory).

Referring now to FIG. 2, the validator 10 has an operating passage-way 18 through which the bill 14 passes as it is processed and validated by the validator 10. The bill receptor 12 provides the entrance to the passage-way 18 and the output port 16 provides the exit for a valid bill 14 which has been processed. The bill 14 is inserted into the bill receptor 12 and moved through the passage-way 18 by a stepper motor 20 which is coupled to respective drive rollers **22*a*, 22*b* and pinch rollers 23*a*,23*b*,** in known manner, for example, using conventional gears and gear drive ratios.

The drive rollers **22*a*,22*b* and pinch roller 23*a* are located near the beginning of the passage-way 18. Located in the front of the rollers 22*b* and 23*a* is a bank note input sensor 25. The bank note input sensor 25 comprises a light emitting diode (LED) 24 and a photo-detector 26 (e.g. a photodiode or a photo-transistor). The LED 24 and photo-detector 26 are coupled to the microcontroller 11, which is shown mounted on an electronic controller board 27. The microcontroller 11 uses the bank note input sensor 25 (i.e. LED 24 and photo-detector 26) to detect the presence of a bill 14. When the bill 14 inserted, the microcontroller 11 activates the stepper motor 20 and rollers 22*a*,22*b*,23*a*,23*b* to pull the bill 14 into the operating passage-way 18 and through a magnetic sensing chamber 28**.

The magnetic sensing chamber 28 comprises a widened portion in the passage-way 18. Directly below the magnetic sensing chamber 28 there is a magnetic sensing head 30. As will be described in detail below, the magnetic sensing head 30 produces an alternating magnetic field and the microcontroller 11 monitors changes to this magnetic field caused by the magnetic characteristics of the bill or bank note 14 when it is present in the chamber 28. A feature of the present invention is that the bank note 14 does not have to come in contact with the magnetic sensing head 30, thereby alleviating problems encountered with prior art devices. As shown in FIG. 2, the magnetic sensing chamber 28 is wider than the operating passage-way 18 at portion 19 and this allows the bank note 14 to move over the magnetic sensing head 30 without making contact. In the preferred embodiment of the invention, the magnetic sensing chamber 28 provides a 0.3 millimeter gap or clearance above the magnetic sensing head 30.

An optical sensing chamber 32 is located beyond the magnetic sensing chamber 28 in the passage-way 18. The optical sensing chamber 32 comprises a light emitting diode array 34 and a photo-detector array 36, which are coupled to respective output and input ports on the microcontroller 11. The microcontroller 11 uses the LED and photo-detector arrays 34,36 to optically scan the bank note 14 to determine the denomination or face value of the note 14. In addition, the optical sensing chamber 32 can be used by the microcontroller 11 to monitor the movement of the bank note 14 through the operating passage-way 18.

The output port 16 also includes a bill output sensor 38 to determine when a bill or bank note 14 has exited the validator 10. The output sensor 38 is coupled to the microcontroller 11 and can comprise an opto-mechanical device, for example, a known optical-interrupt switch.

In operation, after a bank note 14 is inserted into the bill receptor 12, the note 14 is detected by the input sensor 25 and in response, the microcontroller 11 activates the stepper motor 20. Under control of the microcontroller 11, the stepper motor 20 moves the bank note 14 through the passage-way 18. The passage-way 18 includes the magnetic sensing chamber 28 and the optical sensing chamber 32. The magnetic sensing chamber 28 is located above the magnetic sensing head 30 which is mounted in a groove. If the detector array 36 does not sense the border or edge of the bank note 14 within one second after the input sensor was triggered, then the microcontroller 11 will reverse the stepper motor 20 to reject the bank note 14.

When the border of the bank note 14 is detected, the microcontroller 11 starts scanning cycles for the optical and magnetic sensing chambers 28,32. At the completion of the scanning cycles, the microcontroller 11 begins the data processing operations to validate the bank note 14. The data processing operations involve using the magnetic and optical data to validate an genuine bank note and determine its denomination or face value.

If the bank note 14 is validated and the face value of the note is acceptable, then microcontroller 11 activates the stepper motor 20 and the motor 20 rotates the drive roller **22*a* which together with the pinch rollers 23*a*,23*b* move the bank note 14 through the operating passage-way 18 to the output port or exit chamber 16. The exit chamber 16 can be coupled to a secured container or safe. The output sensor 38 detects the egress of the bank note 11 and the microcontroller 11 begins to issue output credit pulses. The number of output credit pulses is based on the detected denomination or face value of the bank note 14. Should another bill (not shown) be inserted before the output sensor 38 detects the exit of the previous bank note 14, the microcontroller 11 will reject both bills (i.e. by reversing the stepper motor 20**) and not issue the output credit pulses.

The bill validator 10 will reject a bill which is not valid (i.e. invalid magnetic signature) or is valid but has an unacceptable denomination or face value. In addition, the validator 10 will eject a bill 14 which is inserted but subsequently pulled outwardly by the user. The microcontroller 11 ejects the bank note 14 by reversing the stepper motor 20 for one second. The validator 10 returns to standby mode when both the output and input sensors 38,23 have cleared. If the output sensor 38 does not clear during the eject cycle, the microcontroller 11 will repeat the eject cycle three more times in an attempt to eject the bill 14. After four of these four eject cycles, the validator 10 will shut off until the bill 14 is manually cleared from the passage-way 18.

In standby mode, the bill validator 10 performs a self-diagnostics routine. The routine is repeated every 15 seconds and involves checking the operation of the magnetic sensing and optical sensing chambers 28,32. The self-diagnostics routine also involves releasing or clearing the output sensor 38. The validator also polls an input line which receives an external enable/disable signal (see FIG. 3 below).

Figure 3:
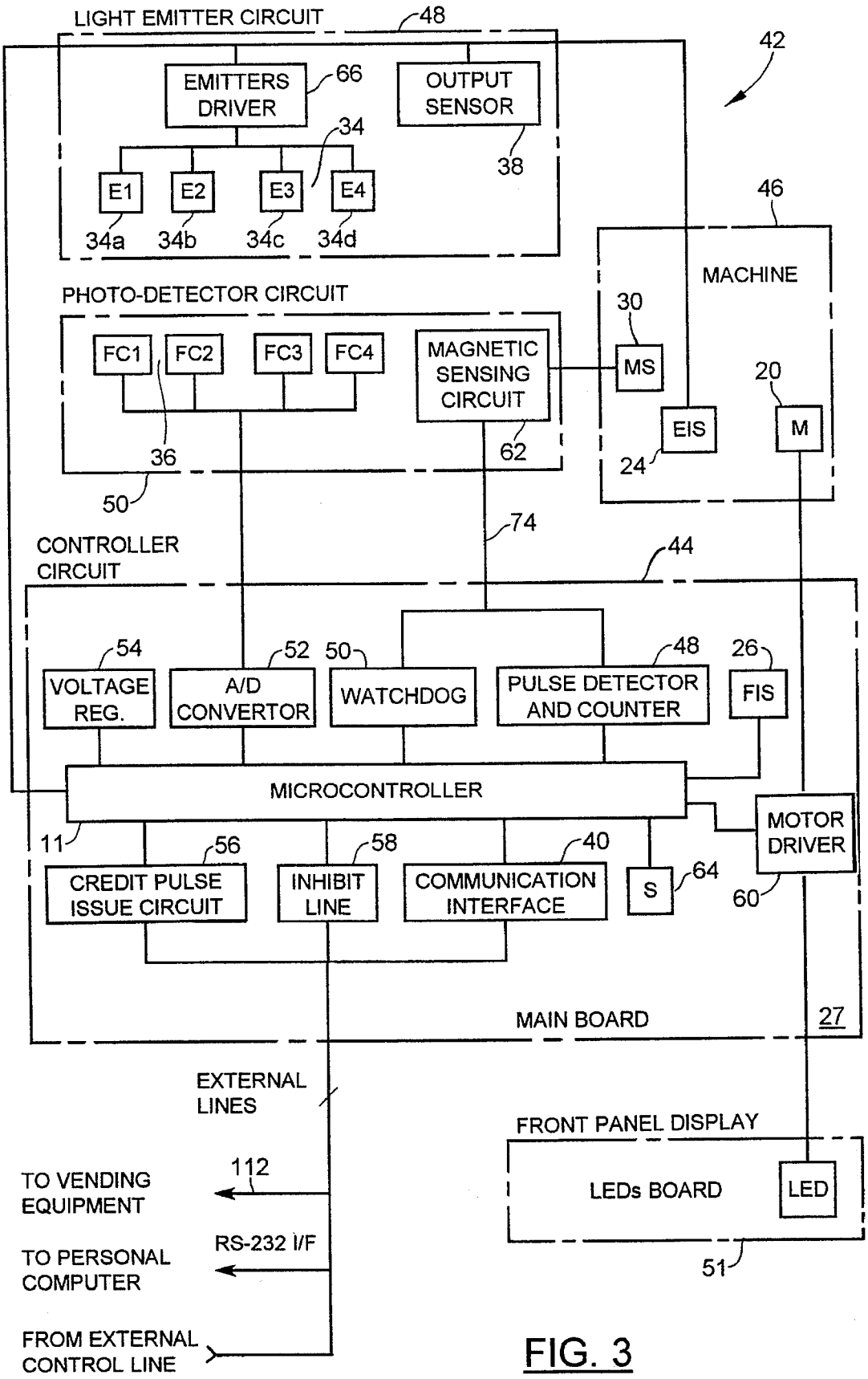
FIG. 3 is a block diagram of the electronic circuit for the bank note validator according to the invention.

Reference is next made to FIG. 3 which shows in block diagram form an electronic circuit 42 for the bill validator 10 according to the invention. The electronic circuit 42 is divided among a number of printed circuit boards or PCB's and comprises a controller circuit 44, a magnetic sensor and motor circuit 46, a light emitter diode circuit 48, a photo-sensor circuit 50 and a front panel LED display circuit 51. The printed circuit boards are electronically coupled to each other through cables.

The controller circuit 44 forms the heart of the electronic circuit 42 and comprises the microcontroller 11, a pulse detector and counter circuit 48, a watch-dog timer 50, an analog-to-digital converter 52, a voltage regulator 54, a credit pulse issue circuit 56, a disable input port 58, and a stepper motor interface 60. In the preferred embodiment, the microcontroller 11 is the MCS80C51 which is manufactured by Intel Corporation. The MCS80C51 is a single chip microcontroller which comprises a microprocessor (CPU) and includes a variety of on-chip resources such as random access memory, input/output ports, a serial communications port, timers, and in a masked version program memory (i.e. Read Only Memory).

The watch-dog timer 50 provides a sanity check for the firmware (i.e. computer program) being executed by the microcontroller 11. The watch-dog timer 50 is tied into the power-on reset circuit (not shown) for the microcontroller 11. If the firmware does not "boot" the watch-dog 50 within a pre-determined period, the watch-dog 50 will time-out and generate a signal which resets the microcontroller 11. In response to a "hard" reset, the firmware executes a start-up which includes operating the stepper motor 20 in reverse for one second to clear any bills 14 which have been in the passage-way 18 prior to the reset. The watch-dog timer 50 can be implemented in a manner readily apparent to those skilled in the art.

The A/D converter 52 digitizes the output signals from the photo-detector array 36 (in the photo-detector circuit 50) and the output of the A/D converter 52 is coupled to input port on the microcontroller 11. The A/D converter 52 is implemented using a four channel device (such as the ADC0834 manufactured by National Semiconductor Corporation) with one channel coupled to each photo-detector in the array 36. The A/D converter 52 together with the photo-detector array 36 and light emitting diode array 34 are used by the microcontroller 11 to implement the various optical functions such as determining the face value of the bill 14 and validating the bill.

The output from the pulse counter and detector circuit 48 is coupled to an input port P0 (see FIG. 4) on the microcontroller 11. As shown in FIG. 3, the input of the pulse circuit 48 is connected to the output of a magnetic sensing circuit 62. The magnetic sensing circuit 62 is coupled to the magnetic sensing head 30. As will be described below, the magnetic sensing circuit 62 produces an output signal that is indicative of changes in the magnetic field produced by the magnetic sensing head 30. In the present embodiment, the magnetic sensing circuit 62 is located on the printed circuit board for the photo-detector circuit 50, but this is merely matter of convenience.

Referring still to FIG. 3, the stepper motor interface 60 couples the microcontroller 11 to the stepper motor 20. The stepper motor interface 60 allows the microcontroller 11 to control the operation of the stepping motor 20, for example, activating the motor, reversing the direction of the motor, etc. These functions can be implemented in the firmware using known techniques within the understanding of one skilled in the art, for example, the sequencing and control of the motor windings.

On the hardware side, the stepper motor interface 60 couples the microcontroller 11 to the windings of the stepper motor 20. The motor interface 60 comprises a four channel push-pull driver such as the LM1923 chip available from National Semiconductor and two pulse diode circuits comprising four diodes each of the type 1N4448. The microcontroller 11 uses the motor interface 60 to "half-step" the motor 20 for smooth movement. In the preferred embodiment, the motor 20 used is the Airpax L82402 which is operated at a rotation speed of 240 steps per second or 300 revolutions per minute and one half-step is 2.08 milliseconds. In known manner, the stepper motor 20 is operated to start transporting from the step at which it was previously stopped.

As shown in FIG. 3, the photo-detector 26 for the input sensor 23 (FIG. 2) is also mounted on the printed circuit board for the controller circuit 44. The photo-detector 26 is coupled to an input port on the microcontroller 11 and provides a simple on/off signal when a bill 14 is present/absent.

Referring still to FIG. 3, the controller circuit 44 also includes a bank of switches 64, which can be implemented using a DIP switch. The switches 64 are coupled to an input port on the microcontroller 11. The settings of the switches 64 are read by the firmware and can be used to set various operating parameters for the validator 10. For example, the switches 64 can set the number of credit pulses issued per $1 (e.g. 1, 2, 3 or 4 pulses/dollar) and denomination acceptance (e.g. $1, $5, $10 and $20 bills).

As shown in FIG. 3, the light emitting diode array 34 comprises four LED's **34*a*,34*b*,34*c*,34*d*. The LED's 34*a*–34*d* are mounted in the optical sensing chamber 32 and coupled to an output port on the microcontroller 11 through an LED driver circuit 66. (The LED 24 in the input sensor 25 can also be coupled to an output on the same port.) On the other side of the optical sensing chamber, the photo-detector array 36 is mounted and comprises four photo-transistors 36*a*,36*b*,36*c*,36*d*. The photo-transistors 36*a*–36*d* are coupled to respective channels of the A/D converter 52. During the optical scanning cycles, the firmware uses the driver circuit 66 to sequence the LED's 34*a*–34*d* and samples the light transmitted through the note 14 using the photodetector array 36**.

The bill validator 10 according to the invention preferably includes a communication interface 40 as shown in FIG. 3. The communication interface 40 provides a connection to an external computer (not shown), for example an IBM PC XT or AT. The bill validator 10 uses the communication interface 40 to send operational data and other logistical information to the computer.

Figure 4:
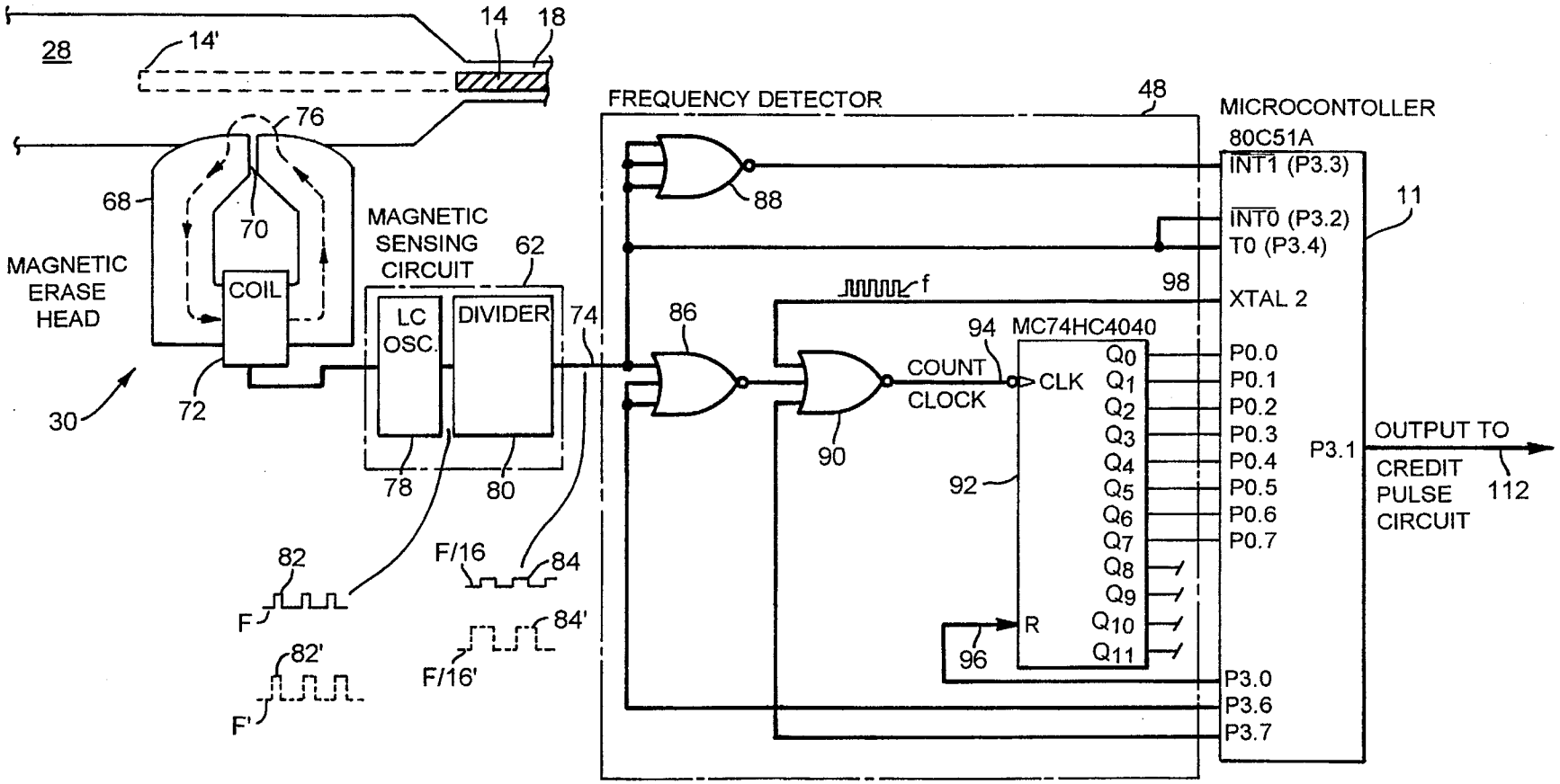
FIG. 4 is a schematic diagram showing in more detail the microcontroller, magnetic sensing and frequency detector circuits.

Reference is next made to FIG. 4 which shows the magnetic sensing head 30, the magnetic sensing circuit 62 and the pulse detector and counter circuit 48 in more detail. The magnetic sensing head 30 is implemented using a magnetic erase head 68 of the type found in audio cassette tape recorders. The magnetic head 68 is made of a magnetically permeable material and has a gap 70 which is positioned in the magnetic sensing chamber 28. At the other end of the head 68 there is a coil 72 which is coupled to the magnetic sensing circuit 62.

The magnetic sensing circuit 62 is mounted on the PCB for the photo-detector circuit 50. The output from the magnetic sensing circuit 62 is coupled to the pulse circuit 48 through a cable (indicated generally by reference 74). The circuits are arranged in this manner in order to put the magnetic sensing circuit 62 close to the magnetic head 68 and coil 72.

In a conventional audio cassette tape player, energizing the coil 72 of the erasing head produces a magnetic field across the gap 70 which would demagnetize the magnetic tape, and erase information recorded on the tape, as it passed across the magnetic head 68. In the present invention, the coil 72 and magnetic head 68 are used to establish a reference magnetic field which is indicated by broken line 76. Any deviations to the magnetic field 76 will cause a change in the output of the coil 72. The output of the coil 72 can be defined by oscillation parameters, such as frequency, phase or amplitude.

Figure 8:
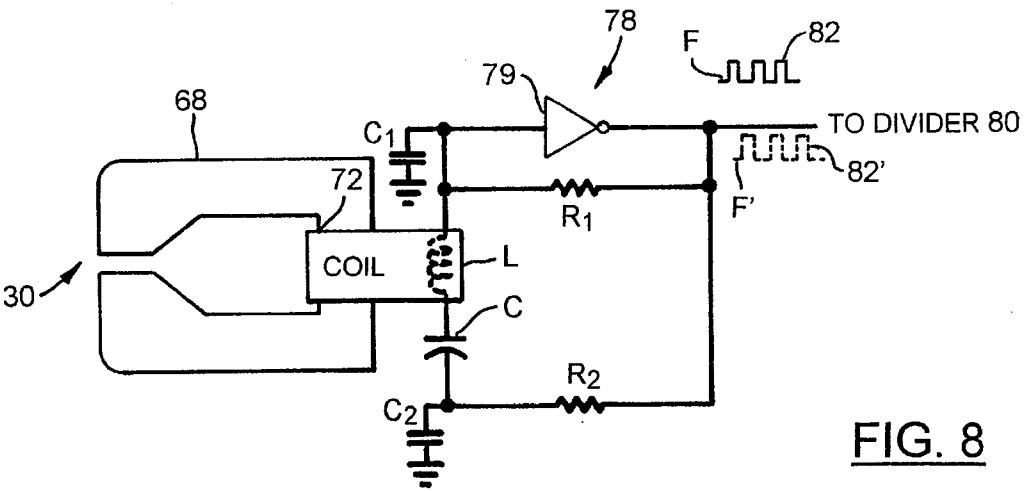
FIG. 8 is a schematic diagram showing in more detail the LC oscillator in FIG. 4.

As shown in FIG. 4, the coil 72 is coupled to the magnetic sensing circuit 62. The magnetic sensing circuit 62 comprises an oscillator 78 and a frequency divider 80. The oscillator 78 comprises a "LC" Pierce oscillator as shown in FIG. 8. The oscillator 78 is coupled to the coil 72 and the coil 72 provides the inductive element for the "LC" oscillator 78. As shown in FIG. 8, the LC oscillator 78 comprises an invertor 79, a pair of resistors $R_1$ and $R_2$, a capacitor C and a pair of bypass capacitors $C_1$ and $C_2$. As shown in FIG. 8, the inductive element L is provided by the coil 72 which is coupled to the capacitor C. In operation, the oscillator 78 will oscillate at a frequency determined by the inductive and capacitive values of the "LC" elements, and the oscillator 78 will energize the coil 72 to produce the magnetic field 76. The oscillating signal produced by the oscillator 78 comprises a series of electrical pulses 82 having an oscillation frequency which will be denoted as F. The frequency divider 80 divides the output signal F to produce a divided output signal F/16 for further processing by the frequency detector 48. The output signal F/16 comprises a series of pulses 84 and has an oscillation frequency which is 1/16 F.

When the bank note 14 passes through the magnetic sensing chamber 28 (shown using a broken outline and indicated by reference 14'), ferromagnetic, paramagnetic and other magnetic particles in the ink or dye on the note 14 will affect the magnetic field 76. The change in the magnetic field 76 causes a respective change in the inductance of the magnetic circuit 70,72. Because the coil 72 provides the inductive element for the LC oscillator 78, a change in the inductance will result in a change to the frequency of oscillation or signal F. In known manner, the sensitivity of the LC oscillator 78 can be tuned according to the values of the inductive and capacitive elements, so that a small change in the magnetic field 76 produces a large change in the oscillation frequency of signal F. Furthermore, the oscillator 78 can be modified so that a change in the magnetic field 76 (due to particles in the ink used on the note 14) produce a change in other oscillation parameters such as phase or amplitude.

Referring still to FIG. 4, a change in the frequency of the oscillator 78 results in an output signal F' comprising a series of pulses 82', and the divider 80 will generate a corresponding divided output signal F'/16 comprising a series of pulses 84'. In FIG. 4, the F' and F/16' signals are shown in broken outline. As will now be described, the microcontroller 11 (and firmware) uses the pulse detector and counter circuit 48 to determine the respective frequencies of the F/16 signal and the F'/16 signal. By subtracting the frequency of the F/16 signal from the F'/16 signal, the firmware determines the deviation or perturbation to the magnetic field 76 caused by the bill 14. The deviation is then used to validate the bill 14 (or other type of document).

As shown in FIG. 4, the output, i.e. the F/16 signal 84, from the magnetic sensing circuit 62 is fed to the pulse detector and counter circuit 48. The pulse circuit 48 comprises three logic NOR gates 86,88,90 and a digital counter 92. The NOR gates 86,88,90 perform a logical gating function, and the output of a gate is "high" if all the inputs are "low".

As shown in FIG. 4, the F/16 signal 84 from the divider 80 is connected to an interrupt input INT0* and to a timer input T0 on the microcontroller 11. The other interrupt input INT1* on the microcontroller 11 is connected to the output of the second NOR gate 88. As shown, the second NOR gate 88 is configured as an inverter (i.e. the inputs are tied together). In this manner, the leading edge (i.e. active low) of a pulse 85 in the F/16 signal 84 triggers the active low interrupt INT1* and the trailing edge of a pulse 85 in the signal 84 triggers the other active low interrupt INT0*. As will be described in more detail below, the microcontroller 11 (and firmware) use the two interrupts INT0*,INT1* to track the rising and failing edges of pulses in the F/16 signal 84 and define a "registering cycle". The timer input T0 is connected to an internal register in the microcontroller 11 which is configured (through firmware) to count the pulses 85 in response to a falling edge. In known manner for the 80C51 microcontroller, the internal register can be configured as a "count-up" or "count-down" timer.

Referring still to FIG. 4, the F/16 signal 84 is gated by the first NOR gate 86 with a gating control signal produced on output pin P3.6 of the microcontroller 11. The output from the NOR gate 86 provides one of the inputs to the third NOR gate 90. The second input of the third NOR gate 90 is coupled to another gating control signal which is generated on output pin P3.7 of the microcontroller 11. The third input of the gate 90 is connected to a clock signal output XTAL2 on the microcontroller 11. The clock signal output XTAL2 produces a sampling or counting clock signal denoted by f, which in the preferred embodiment has a frequency of 11.059 MegaHertz (i.e. MHz). The oscillation frequency of the clock signal output XTAL2 is derived from a crystal oscillator as will be understood by those familiar with the 80C51 microcontroller.

The counter 92 is implemented using a binary ripple counter, such as the 74HC4040 available from Motorola. The counter 92 has a clock input 94 and a reset input 96, and twelve output lines Q0 to Q11. In the invention, eight output lines Q0 to Q7 are connected to respective input pins P0.0 to P0.7 on Porto of the microcontroller 11. The reset input 96 is connected to an output pin P3.0 on the microcontroller 11. In response to an active high signal on output P3.0, the counter 92 will reset or clear the output lines Q0 to Q11. The state of the counter 92 is advanced for each negative-going edge on the clock input 94. Referring to FIG. 4, the signal on the clock input 94 will go "high-to-low" (and the counter 92 will advance) when all the inputs to the third NOR gate 90 are low and then at least one input goes high, i.e. the gated frequency signal output from NOR gate 86 is "low", the gating control signal on output P3.7 is "low" and the clock signal output XTAL2 goes from "low-to-high"—see below. The state of the counter 92, i.e. outputs Q0 to Q7, is read by microcontroller 11 through input Port0.

Figure 5:
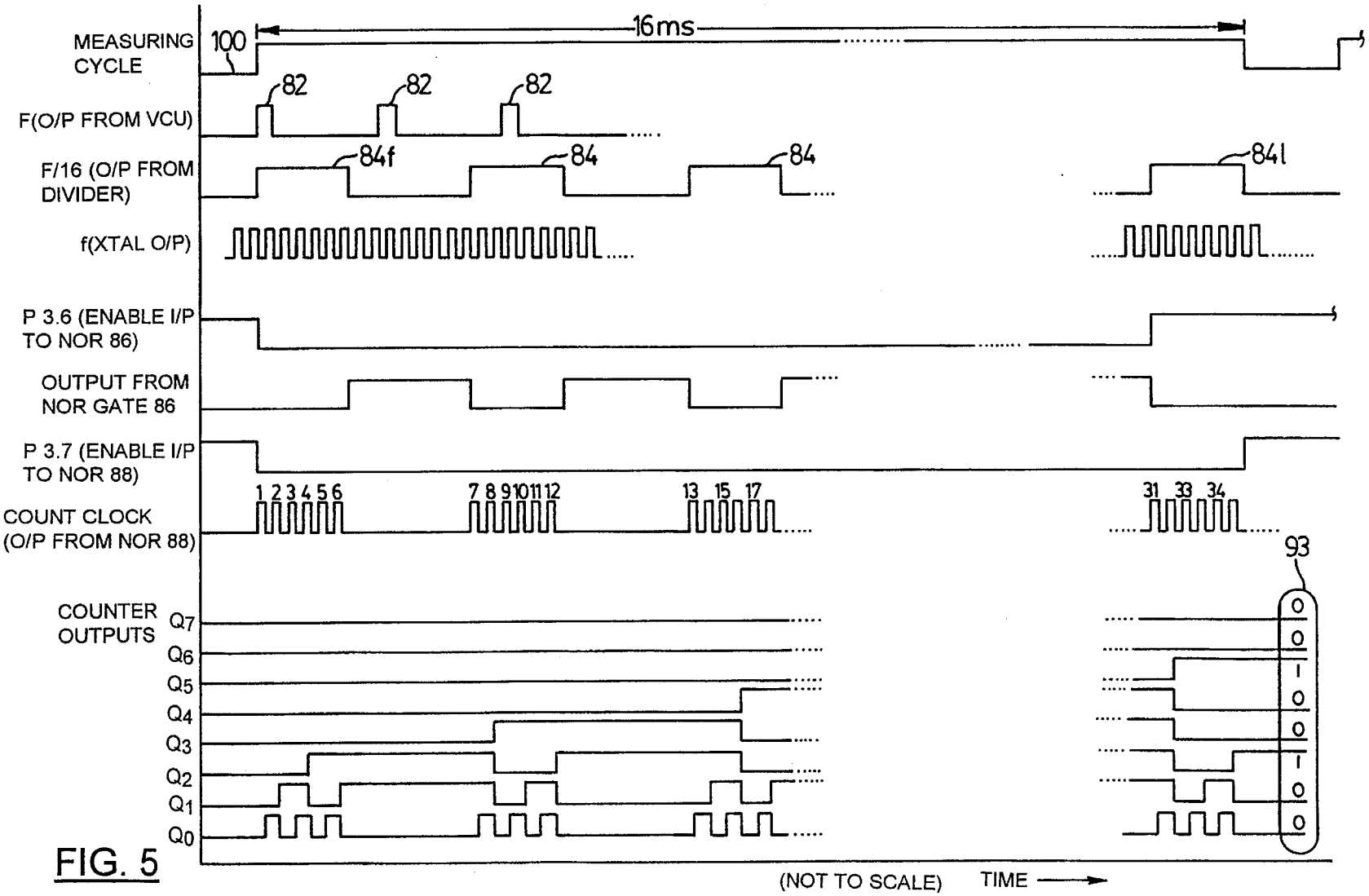
FIG. 5 is a timing diagram showing the relationship between signals generated by the bank note validator when the magnetic sensing chamber is empty.
Figure 6:
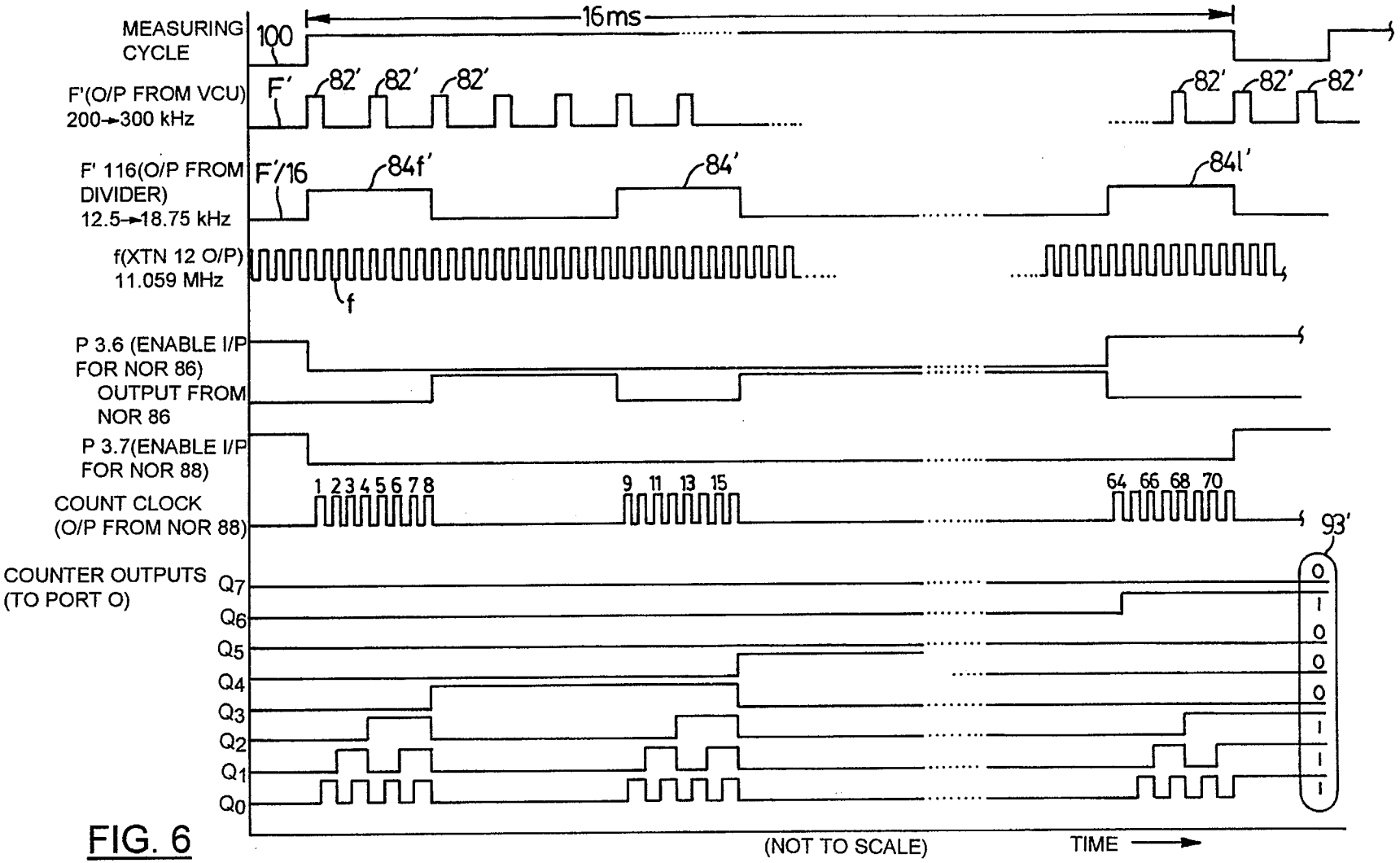
FIG. 6 is a timing diagram showing the relationship between signals generated by the bank note validator when a bank note is present in the magnetic sensing chamber.

The operation of the pulse detector and counter 48 will now be described with reference to FIG. 4 and the timing diagrams shown in FIGS. 5 and 6. In FIGS. 4 to 6, corresponding reference numbers are used to indicated corresponding elements.

To validate a bank note 14 which has been inserted into the validator 10, a base-line frequency value for the F/16 signal is determined before the bill 14 reaches the magnetic sensing chamber 28. Because the magnetic response of the head 30 can be affected by external conditions, such as humidity and temperature, it is preferable to calculate the base-line frequency value just before the bill 14 reaches the sensing chamber 28. Subsequently, when the bill 14' enters the magnetic sensing chamber 28, the microcontroller 11 (and firmware) determines the frequency of the F'/16 signal and compares it to base-line frequency value for the F/16 signal. The difference between the two frequencies represents the deviation or perturbation to the magnetic field 76 which is then used to validate the bank note or bill 14.

Reference is made to FIGS. 4 and 5 to describe the steps performed by the microcontroller 11 (and firmware) to determine the base-line frequency value. The base-line value corresponds to the frequency of the F/16 signal when the chamber 28 is empty.

To determine the frequency of the F/16 signal, the microcontroller 11 (through the firmware) "registers" each pulse 84 in the signal F/16 over a pre-determined time interval. As will be described below, the operation of "registering" involves counting each pulse 84 over the pre-determined time interval. In FIG. 5, the predetermined interval is termed the measuring cycle and denoted by reference 100. In the preferred embodiment, the measuring cycle 100 has a duration of 16 milliseconds.

Before the frequency of the F/16 signal can be determined, the microcontroller 11 is "tuned" to the F/16 signal. The "tuning" operation involves counting the number of pulses 84 present in the F/16 signal over the duration of the measuring cycle 100. The microcontroller 11 uses the internal register coupled to the timer input t0 to count the number of pulses 84. (For the 80C51, the timer T0 is configured to be sensitive to a "high-to-low" transition, i.e the falling edge of the pulse 84.) The pulse count is then used to keep track of the measuring cycle 100 during the "registering" procedure.

To determine the frequency of the F/16 signal, the microcontroller 11 registers each pulse 84 in the F/16 signal over the course of the measuring cycle 100 (which can be determined using the pulse count from the tuning operation). As will be described, the registering cycle involves counting or determining the width of each pulse 84 in the F/16 signal and keeping a running count using the counter 92. At the end of the measuring cycle 100, the microcontroller 11 reads the "count" (indicated by reference 93 in FIG. 5) from the counter 92 which is coupled to the input port P0–P7.

The registering cycle is commenced by the microcontroller 11 resetting the counter 92, and setting the output lines P3.6 and P3.7 low (which enables the NOR gates 86,90). The first NOR gate 86 is used to "gate" the pulses 84 in the F/16 signal. The second NOR gate 88, on the other hand, "gates" the clock signal f but only over the duration of the pulse 84 (because the output from the NOR gate 86 provides one of the inputs). The microcontroller 11 resets the counter 92 by outputting an active high pulse on output P3.0. If not done so already, the microcontroller 11 "tunes" to the F/16 signal, i.e. counts the number of pulses 84 over the duration of the measuring cycle 100.

Next, the microcontroller 11 enables the interrupts INT0* and INT1*. It will be recalled that both interrupts INT0*, INT1* are triggered by falling clock edges, therefore, INT1* is triggered by the leading edge of a pulse 84 (which is inverted by gate 88) in the F/16 signal and interrupt INT0* is triggered by the trailing edge of a pulse 84 in the F/16 signal.

In response to the leading edge of the first pulse 84*f* (i.e. interrupt INT1*) for the measuring cycle 100, the microcontroller 11 resets the counter 92 (by pulsing high the output line P3.0), and enables the NOR gates 86,88 by setting the output lines P3.6,P3.7 low. To monitor the measuring cycle 100, the tuning count is loaded in the internal timer register which is configured to count-down for each "high-to-low" transition (i.e. pulse 84) appearing on input T0. With the NOR gates 86,88 enabled, the pulse circuit 48 can start "counting" or "registering" the width of each pulse in the F/16 signal by clocking the counter 92. Because a pulse 84 in the F/16 signal is gated with the clock signal f produced on output line XTAL2, each "low-to-high" transition in the clock signal f will advance the state of the counter 92 over the duration of the pulse 85'. This is shown in FIG. 5 by the advance or count appearing on the outputs Q0 to Q7 of the counter 92 for each falling edge of the count clock f.

At the end of the measuring cycle 100, the microcontroller 11 disables the NOR gate 90 by pulling output line P3.7 high. The microcontroller 11 then inputs the "count" 93 produced by the counter 92 by reading the input port P0.0 to P0.7. The end of the registering cycle, i.e. last pulse 84 for the measuring cycle, can be synchronized to the falling edge of the last pulse 841 through the interrupt INT0*. It will be remembered that the interrupt INT0* is triggered by the falling edge of a pulse 84 in the F/16 signal. As described above, the measuring cycle 100 can be timed according to the number of pulses counted at the timer input T0 during the tuning step. At the end of the measuring cycle 100, the frequency for the F/16 signal 84 is determined from the count 93 registered over the measuring cycle 100.

When the bank note 14' enters the sensing chamber 28, the microcontroller 11 (and firmware) repeat the same procedure to determine the frequency of the F'/16 signal which is produced when the bank note 14' interacts with the magnetic field 76. At the end of the measuring cycle 100, the counter 92 produces a count 93' for the F'/16 signal. The firmware then determines a corresponding frequency from the count 93'. Since the magnetic properties of the bank note 14' can vary over its length, a number of measuring cycles 100 can be performed to obtain a number of counts 93' which provide a profile (i.e. signature) of the magnetic properties along the length of the bank note 14.

To validate a bank note 14, the firmware first determines a deviation value by subtracting the base-line frequency value from the frequency value for F'/16. Next, the firmware determines if the deviation value is within a predetermined range which is indicative of an authentic bank note 14. For a genuine bank note 14, the deviation will fall in a pre-determined range, and any deviation falling outside the pre-determined range can be used to reject counterfeit bills or bank notes. For example, the ink in a counterfeit bill which was produced by a photocopier will have different characteristics. This cause the validator 10 to generate a deviation value which is outside the range of those produced by authentic bills. In known manner, the firmware can be programmed for a range of deviation values corresponding to various magnetic signatures.

Referring again to FIG. 4, once the bank note or bill 14 has been validated, the validator 10 will issue credit pulses on output P3.1. The credit pulses are used by other equipment, for example a token dispenser, to give "credit" to a customer based on the denomination of the bill 14. The number of credit pulses issued by the validator 10 depends on the denomination of the bill 14 and issue pulse settings. The number of pulses issued per dollar of denomination is selected using the switch 64. The microcontroller 11 reads the settings of the switch 64 and depending on the switch settings will produce one pulse/dollar, two pulses/dollar, three pulses/dollar or four pulses/dollar.

According to the invention, the validator 10 encodes the pulses and issues them as a credit packet which is modulated typically at a high frequency. By encoding the credit pulses in a packet, the security and reliability of the bank note validator 10 is improved because it becomes more difficult to trick the validator 10 into issuing credit pulses, for example, using a high energy stun gun.

The reliability and security of the credit pulses issued according to the invention is further enhanced by tying the modulation of the credit packet into a pulse servicing routine executed by the microcontroller 11 in firmware. Because the credit packet is modulated in firmware, should the firmware or microcontroller 11 go awry, e.g. due to a discharge by a stun gun, proper credit pulses will not be issued.

Figure 7:
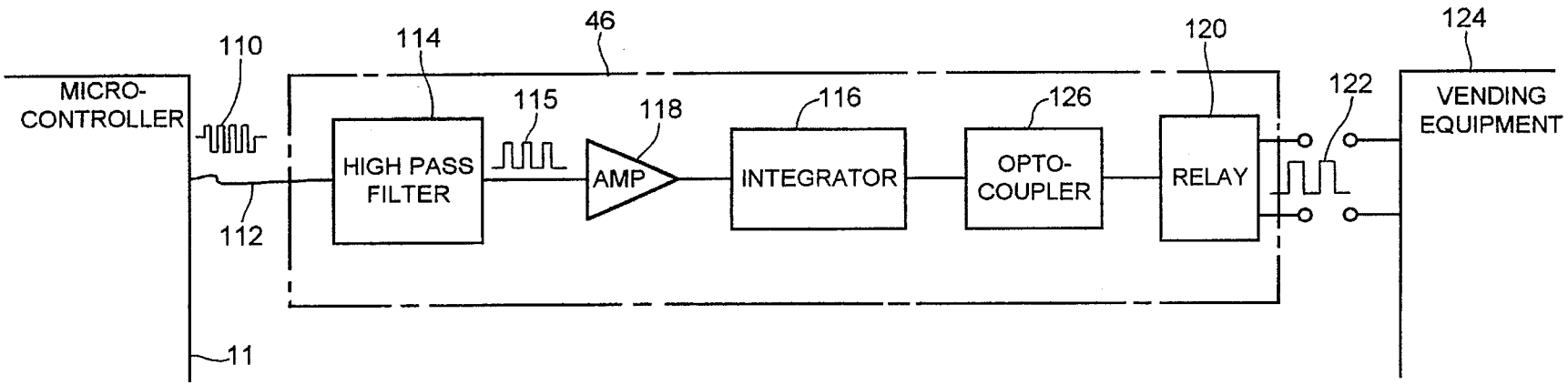
FIG. 7 is a block diagram showing an output pulse issue circuit for the bank note validator according to the invention.

According to the invention, the credit pulse issue circuit 46 is included to decode the packet and pulse the equipment connected to the validator 10. Reference is next made to FIG. 7, which shows the credit pulse issue circuit 46 in more detail. In response to a valid bank note 14, the firmware will generate a credit pulse packet 110 (on an output port P3.1 of the microcontroller 11). In the preferred embodiment, the credit pulse packet 110 has a duration of 50 ms and comprises 300 kHz pulses with a pause of 50 ms or 300 ms (selectable by switch 64) between packet bursts. The credit pulse packet 110 is received and decoded by the credit pulse issue circuit 46, which then issues credit pulses to the vending equipment, e.g. a subway token dispenser. The credit pulse issue circuit 46 is coupled to the validator 10 through a line 112, and therefore can be positioned away from the validator 10.

As shown in FIG. 7, the credit pulse issue circuit 46 comprises a high pass filter 114, and an integrator 116. The high pass filter 114 is connected to the output line 112 from the microcontroller 11. The output from the high pass filter 114 is coupled to the input of the integrator 116 through an amplifier 118. The output from the integrator 116 drives a relay 120 which provides "vend" pulses 122 for the vending equipment, indicated generally by reference 124. To provide isolation and improve noise immunity, the integrator 116 is connected to the relay 120 through an opto-coupler 126.

The credit pulse issue circuit 46 decodes the packet 110 and issues vend pulses 122 as follows. The credit pulse packet 110 is received by the high pass filter 114 which differentiates (i.e. demodulates) the packet 110 by stripping the 300 kHz carrier and producing a series of pulses 115. The number of pulses now corresponds to the denomination value which was determined by the validator 10. Each pulse 115 is amplified and integrated to produce a voltage signal which through the opto-coupler 126 activates the relay 120. The relay 120, in turn, produces a vend pulse 122 at the level expected by the vending equipment 124.

It will be evident to those skilled in the art that other embodiments of the invention fall within its spirit and scope as defined by the following claims.

We claim:

1. A validator for validating the authenticity of bank notes and other valuable documents having a predefined signature produced by magnetizable material in said document, said validator comprising:

(a) receiving means for receiving the document, including a passage-way for containing the document;

(b) transport means for transporting the document through said passage-way;

(c) signature detector means for detecting the signature of the document, said signature detector means including (i) sensor means for producing an AC magnetic field in said passage-way, (ii) oscillator means for producing an oscillator signal, said oscillator means being connected to said sensor means to cause said sensor means to generate said AC field, said oscillator means including inductance means therein, said sensor means forming at least part of said inductance means, (iii) the presence of a document containing magnetizable material in close proximity to said sensor means causing a variation in the inductance of said inductance means, whether or not said magnetizable material is magnetized, and said oscillator means including means responsive to a change in said inductance for varying a parameter of said oscillator signal dependant on said variation in inductance; and (d) processor means for processing said oscillator signal and generating an output validation signal indicative of an authentic document.

2. The validator as claimed in claim 1, wherein said processor means includes means for converting said oscillator signal into a pulsed signal comprising a plurality of pulses and pulse counter means for counting the pulses in said pulsed signal.

3. The validator as claimed in claim 2, wherein said pulse counter means comprises sampling means for sampling the width of each pulse and producing a clocking signal for each sample of said pulse width and counter means responsive to said clocking signal for counting the number of samples and producing a pulse count.

4. The validator as claimed in claim 3, wherein said processor means includes means for reading said, pulse count and generating a frequency value from said pulse count, said frequency value being indicative of the frequency of said pulsed signal.

5. The validator as claimed in claim 2, wherein said sensor means comprises an electromagnetic device having a magnetic conductor and a coil, said coil forming a part of said oscillator means.

6. The validator as claimed in claim 5, wherein said magnetic conductor comprises a substantially U-shaped body having a pair of poles, and an air gap between said poles.

7. The validator as claimed in claim 2, wherein said means for converting includes divider means for dividing the frequency of said pulsed signal to produce a divided pulsed signal having a frequency less than the frequency of said pulsed signal.

8. The validator as claimed in claim 1 wherein said passage-way has a thickness greater than that of said document, said transport means including means for transporting said document without pressing said document against said sensor head means, whereby to facilitate validation of worn documents.

9. The validator as claimed in claim 1 wherein said parameter of said oscillator signal is the frequency of said oscillator signal.

10. The validator as claimed in claim 1 wherein said processor means includes means for processing said oscillator signal in the absence of a document adjacent said sensor means to obtain a base line value, means for processing said oscillator signal in the presence of a document adjacent said sensor means to produce a modified value, means for comparing said base line and modified values to produce a deviation value indicative of the difference between them, and means for generating an output validation signal if said deviation value is within a predetermined range.

11. A validator for validating the authenticity of bank notes and other valuable documents having a predefined signature which affects a magnetic field, said validator comprising:

(a) receiving means for receiving the document, including a passage-way for containing the document;

(b) transport means for transporting the document through said passage-way;

(c) signature detector means for detecting the signature of the document including magnetic means for producing a magnetic field in said passage-way, and sensing means for sensing change in said magnetic field created by the document and producing a sensor output signal in response thereto; and (d) processor means for processing said sensor output signal and generating an output validation signal indicative of an authentic document, (e) said sensor output signal comprising an electrical signal, and said processor means including means for converting said electrical signal into a pulsed signal comprising a plurality of pulses and pulse counter means for counting the pulses in said pulsed signal, (f) said means for converting comprising an oscillator having an input for receiving said electrical signal and means responsive to said electrical signal for generating said pulsed signal with the number of pulses being derived from said electrical signal, (g) said pulse counter means comprising sampling means for sampling the width of each pulse and producing a clocking signal for each sample of said pulse width and counter means responsive to said clocking signal for counting the number of samples and producing a pulse count, (h) said processor means further including means for reading said pulse count and generating a frequency value from said pulse count, said frequency value being indicative of the frequency of said pulsed signal, (i) said processor means further including means for comparing said frequency value to a base-line frequency value and producing a deviation value, and means responsive to said deviation value and producing said output validation signal if said deviation value is within a pre-determined range.

12. The validator as claimed in claim 11, wherein said processor means includes means for detecting the presence of a document in said passage-way and means for determining said base-line frequency value when a document is not present in said passage-way.

13. A method for validating the authenticity of bank notes and other documents having a predefined signature produced by magnetizable material in said documents, said method comprising:

(a) moving said document past a sensor head in proximity to said sensing head but without pressing said document against said sensor head, (b) providing an oscillator connected to said sensor head so that said sensor head forms an inductance element of said oscillator, and generating an AC oscillator signal in said oscillator to produce an AC magnetic field adjacent said sensor head, said oscillator signal having a parameter dependant on the inductance of said inductance element, (c) the presence of a document containing magnetizable material in proximity to said sensor head causing a variation in said inductance in said oscillator circuit and hence causing a variation in said parameter of said oscillator signal, (d) processing said oscillator signal and generating an output validation signal indicative of an authentic document.

14. The method as claimed in claim 13 wherein said parameter of said oscillator signal is the frequency of said oscillator signal.

15. The method as claimed in claim 14 and including the steps of processing said oscillator signal in the absence of a document adjacent said sensor means to obtain a base line value, and then processing said oscillator signal in the presence of a document adjacent said sensor head to produce a modified value, comparing said base line and modified values to produce a deviation value indicative of the difference between them, and generating an output validation signal if said deviation value is within a predetermined range.

* * * * *